US010233072B2

(12) United States Patent
Foster et al.

(10) Patent No.: US 10,233,072 B2
(45) Date of Patent: Mar. 19, 2019

(54) DIESEL EXHAUST FLUID SYSTEMS

(71) Applicant: Benecor, Inc., Brighton, MI (US)

(72) Inventors: Brendan J. Foster, Fenton, MI (US); Hendrik F. Stoltz, Milford, MI (US)

(73) Assignee: Benecor, Inc., Brighton, MI (US)

( * ) Notice: Subject to any disclaimer, the term of this patent is extended or adjusted under 35 U.S.C. 154(b) by 728 days.

(21) Appl. No.: 14/638,022

(22) Filed: Mar. 4, 2015

(65) Prior Publication Data

US 2015/0252712 A1 Sep. 10, 2015

Related U.S. Application Data

(60) Provisional application No. 61/947,812, filed on Mar. 4, 2014.

(51) Int. Cl.

| | |
|---|---|
| ***F01N 3/00*** | (2006.01) |
| ***B67D 7/78*** | (2010.01) |
| ***B67D 7/02*** | (2010.01) |
| ***B67D 7/62*** | (2010.01) |
| ***F01N 3/10*** | (2006.01) |

(52) U.S. Cl.

CPC ..... *B67D 7/78* (2013.01); *B67D 7/02* (2013.01); *B67D 7/0294* (2013.01); *B67D 7/62* (2013.01); *F01N 3/103* (2013.01); *F01N 3/106* (2013.01); *Y10T 137/86035* (2015.04); *Y10T 137/86075* (2015.04)

(58) Field of Classification Search

CPC ..... B67D 7/02; B67D 7/0294; B67D 7/62; B67D 7/78; F01N 3/103; F01N 3/106; F01N 3/2896; Y10T 137/86035; Y10T 137/86075

USPC ..... 222/14, 20, 544

See application file for complete search history.

(56) References Cited

U.S. PATENT DOCUMENTS

| | | | | | |
|---|---|---|---|---|---|
| 4,069,841 | A * | 1/1978 | Bartlett | F23K 5/04 | 137/565.34 |
| 5,020,566 | A * | 6/1991 | Shoop | F02M 37/0023 | 137/192 |
| 5,090,594 | A * | 2/1992 | Randall, Jr. | G01F 11/284 | 222/1 |
| 5,203,367 | A * | 4/1993 | Akai | B65B 3/06 | 137/563 |
| 5,480,063 | A * | 1/1996 | Keyes | G01F 11/284 | 137/563 |
| 5,983,869 | A * | 11/1999 | Cooke | F02M 55/002 | 123/514 |

(Continued)

*Primary Examiner* — Phutthiwat Wongwian
*Assistant Examiner* — Diem Tran
(74) *Attorney, Agent, or Firm* — Howard & Howard Attorneys PLLC

(57) ABSTRACT

A diesel exhaust fluid system for use on a diesel-powered machine, including a storage tank adapted to store diesel exhaust fluid, a receiver, and a shut-off valve. The receiver is disposed in selective fluid communication with the storage tank and is adapted to receive diesel exhaust fluid. The shut-off valve is interposed in fluid communication between the storage tank and the receiver and has: a first position wherein diesel exhaust fluid can flow from the receiver to the storage tank, and a second position wherein flow is interrupted from the receiver to the storage tank. The shut-off valve moves from the first position to the second position in response to predetermined accumulation of diesel exhaust fluid in the storage tank.

20 Claims, 1 Drawing Sheet

(56) References Cited

U.S. PATENT DOCUMENTS

| | | | | |
|---|---|---|---|---|
| 7,155,331 | B1 * | 12/2006 | Zhang | F01N 3/0821 60/286 |
| 8,241,577 | B2 * | 8/2012 | Georis | F01N 3/2066 137/265 |
| 8,394,866 | B2 * | 3/2013 | Friedlaender | B29B 17/02 422/134 |
| 8,820,052 | B2 * | 9/2014 | Levin | F01N 3/2066 60/274 |
| 9,316,216 | B1 * | 4/2016 | Cook | F04B 23/06 |
| 9,494,069 | B2 * | 11/2016 | Haeberer | F01N 3/2066 |

* cited by examiner

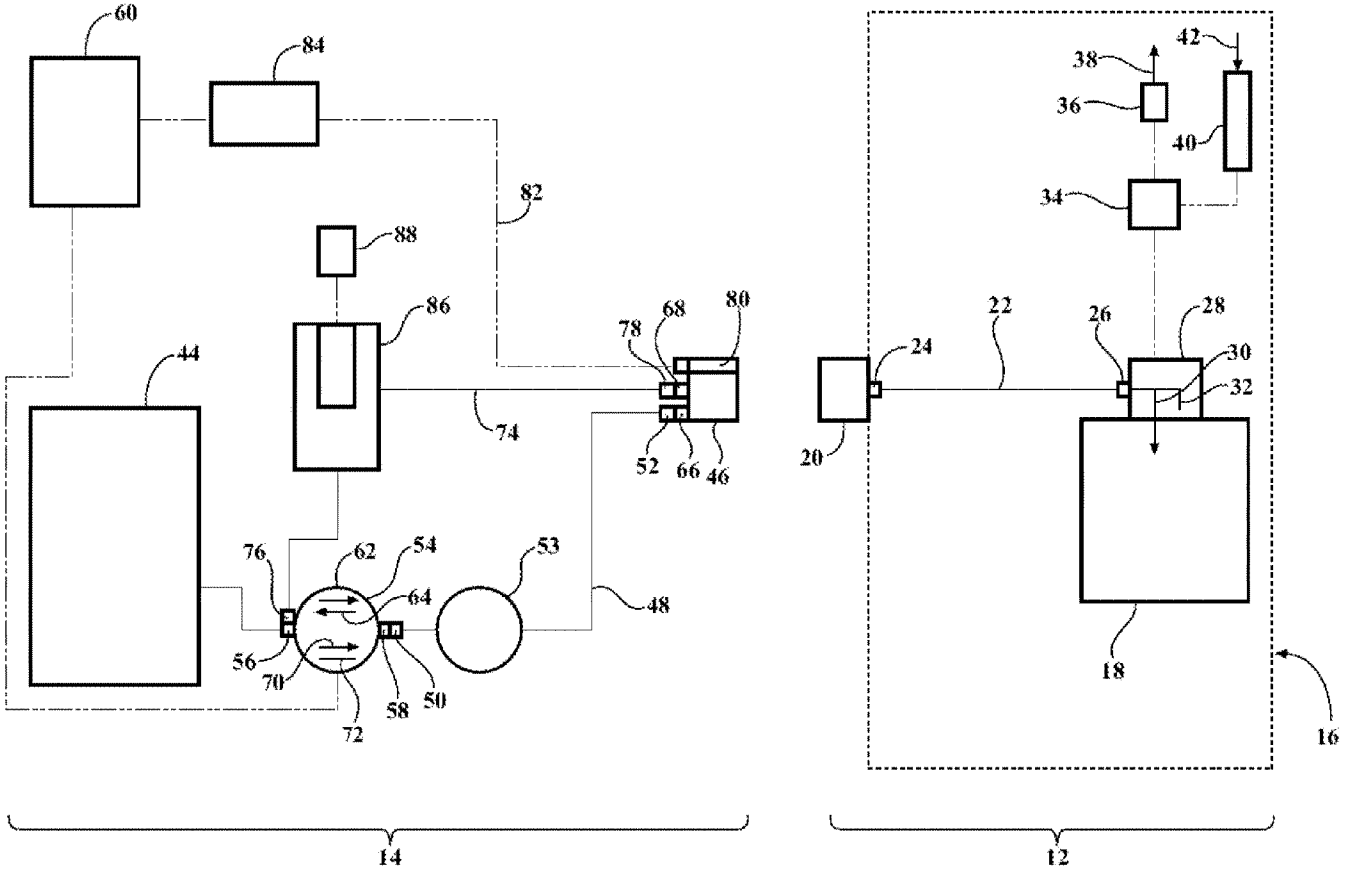
16
42
40
38
36
34
28
30
32
26
18
22
24
20
12
80
46
68
66
78
52
48
82
74
53
86
88
54
64
50
58
62
72
84
76
56
70
44
60
14

DIESEL EXHAUST FLUID SYSTEMS

CROSS REFERENCE TO RELATED APPLICATIONS

This application claims the benefit of U.S. provisional patent application entitled "Diesel Exhaust Fluid Systems and Related Method of Use," having Ser. No. 61/947,812, and filed on Mar. 4, 2014.

BACKGROUND OF INVENTION

1. Field of Invention

The present invention relates generally to diesel exhaust fluid systems, and more specifically, to diesel exhaust fluid filling and storing systems.

2. Description of the Related Art

In conventional diesel engine systems, Diesel Exhaust Fluid (DEF) is frequently used as an additive in Selective Catalytic Reduction (SCR) emission systems, whereby nitrogen oxides (NOx) are converted into diatomic nitrogen, water, and carbon dioxide. DEF systems known in the art typically include two discrete systems: a DEF storage system mounted to a diesel-powered machine, and a DEF supply system used to re-fill the DEF storage system. Because DEF is consumed when the diesel engine runs, the DEF storage system must be designed so as to cooperate with the DEF supply system such that the DEF storage system can be re-filled when needed.

SCR systems are sensitive to contamination and, as such, DEF storage systems must be filled carefully. To this end, DEF storage systems and DEF filling systems must each be designed so as to prevent exposure to contaminants. Further, the type of DEF most commonly used in the art is an aqueous solution consisting of 32.5% urea and 67.5% deionized water. This solution has a relatively high freezing temperature of 11° C. and expands when frozen. As such, DEF storage systems also typically include some sort of heating or thawing system to either prevent DEF from freezing, or to thaw the DEF after the diesel engine is started. Consequently, DEF storage systems must be designed in such a way that they do not crack or leak if the DEF freezes, as a cracked DEF storage system could expose the DEF to contamination and could lead to DEF leaking into the environment.

Conventional DEF storage systems known in the art typically include some type of storage tank mounted to the diesel-powered machine. The storage tank stores DEF for selective injection into diesel-powered machine's exhaust stream. The storage tank is often mounted on the diesel-powered machine in such a way that it is relatively difficult to gain access to. As such, DEF storage systems also typically include a receiver spaced from the storage tank and mounted somewhere on the diesel-powered machine that is relatively easier to access. The receiver is connected to the storage tank by a supply line routed within the diesel-powered machine, and is adapted to connect the DEF storage system to the DEF supply system.

DEF supply systems know in the art typically include a main supply tank filled with DEF, a pump connected to the main supply tank, a nozzle adapted to connect to the receiver of the DEF storage system, and a feed line that extends in fluid communication between the nozzle and the pump. Thus, when the DEF storage system runs low and needs to be re-filled, the nozzle can be connected to the receiver of the DEF storage system and the pump can subsequently transfer DEF from the main supply tank to the storage tank of the DEF storage system.

Each of the components of a DEF system of the type described above must cooperate to effectively fill a storage tank on a diesel-powered machine. In addition, each of the components must be designed so as to enable the storage tank to be filled quickly and efficiently. Further, each of the components must cooperate so as to protect against DEF contamination and DEF leaking into the environment. While the DEF systems known in the related art have generally performed well for their intended purpose, there remains a need in the art for a DEF system that has superior operational characteristics, provides simple, reliable, and quick filling of a storage tank, and is designed in such a way so as to enable the DEF storage system to be used in harsh environments without the risk of leaking or exposure to contaminants.

SUMMARY OF THE INVENTION

The present invention overcomes the disadvantages in the related art in a diesel exhaust fluid storage system for use on a diesel-powered machine. The storage system includes a storage tank, a receiver, and a shut-off valve. The storage tank is adapted to store diesel exhaust fluid. The receiver is disposed in selective fluid communication with the storage tank and is adapted to receive diesel exhaust fluid. The shut-off valve is interposed in fluid communication between the storage tank and the receiver. The shut-off valve has: a first position, wherein diesel exhaust fluid can flow from the receiver to the storage tank; and a second position, wherein flow is interrupted from the receiver to the storage tank. The shut-off valve moves from the first position to the second position in response to predetermined accumulation of diesel exhaust fluid in the storage tank.

In addition, the present invention is directed toward a diesel exhaust fluid supply system for cooperating with a diesel-powered machine having a diesel exhaust fluid storage system including a receiver disposed in fluid communication with a shut-off valve mounted on a storage tank via a supply line. The supply system includes a main supply tank, a nozzle, and a fluid pump. The main supply tank is adapted to store diesel exhaust fluid. The nozzle is disposed in selective fluid communication with the main supply tank and is configured so as to releasably attach to the receiver of the storage system. The fluid pump is interposed in fluid communication between the main supply tank and the nozzle. The fluid pump is adapted to fill the storage tank when the nozzle is releasably attached to the receiver. The fluid pump has: a first pumping direction wherein diesel exhaust fluid is displaced from the main supply tank to the storage tank; and a second pumping direction wherein the fluid pump reverses flow direction such that diesel exhaust fluid is drained from the supply line to the main supply tank. The fluid pump switches from the first pumping direction to the second pumping direction in response to a predetermined increase in fluid pressure occurring in at the nozzle.

Further, the present invention is directed toward a diesel exhaust fluid system comprising a storage system for use on a diesel-powered machine, and a supply system for filling the storage system. The storage system includes a storage tank, a receiver, a supply line, and a shut-off valve. The storage tank is adapted to store diesel exhaust fluid. The receiver is disposed in selective fluid communication with the storage tank and is adapted to receive diesel exhaust fluid. The supply line extends between the storage tank and the receiver. The shut-off valve is interposed in fluid communication between the storage tank and the receiver. The shut-off valve has: a first position, wherein diesel exhaust fluid can flow from the receiver to the storage tank; and a second position, wherein flow is interrupted from the receiver to the storage tank. The shut-off valve moves from the first position to the second position in response to predetermined accumulation of diesel exhaust fluid in the storage tank. The supply system includes a main supply tank, a nozzle, and a fluid pump. The main supply tank is adapted to store diesel exhaust fluid. The nozzle is disposed in selective fluid communication with the main supply tank and is configured so as to releasably attach to the receiver of the storage system. The fluid pump is interposed in fluid communication between the main supply tank and the nozzle. The fluid pump is adapted to fill the storage tank when the nozzle is releasably attached to the receiver. The fluid pump has: a first pumping direction wherein diesel exhaust fluid is displaced from the main supply tank to the storage tank; and a second pumping direction wherein the fluid pump reverses flow direction such that diesel exhaust fluid is drained from the supply line to the main supply tank. The fluid pump switches from the first pumping direction to the second pumping direction in response to a predetermined increase in fluid pressure occurring in at the nozzle.

In this way, the DEF systems of the present invention cooperate to effectively fill a DEF storage tank on a diesel-powered machine. In addition, the DEF systems of the present invention enable simple, reliable, and fast filling of the storage tank and are designed in such a way so as to enable the DEF storage system to be used in harsh environments without the risk of leaking or exposure to contaminants.

BRIEF DESCRIPTION OF THE DRAWINGS

Other objects, features, and advantages of the present invention will be readily appreciated as the same becomes better understood after reading the subsequent description taken in connection with the accompanying drawing wherein:

FIG. 1 is a schematic diagram of components of the various the DEF systems of the present invention.

DETAILED DESCRIPTION OF THE EMBODIMENTS OF THE INVENTION

With reference to FIG. 1, a Diesel Exhaust Fluid (DEF) system is schematically illustrated at 10. The DEF system 10 includes a DEF storage system 12 and a DEF supply system 14. Each of these systems will be described in greater detail below.

The DEF storage system 12 is used to provide DEF to a diesel-powered machine, generally indicated at 16, for use in Selective Catalytic Reduction (SCR) diesel emission systems. As shown in FIG. 1, the DEF storage system 12 is integrated with the diesel-powered machine 16. However, those having ordinary skill in the art will appreciate that the DEF storage system 12 could be mounted in any suitable location with respect to the diesel-powered machine 16 without departing from the scope of the present invention. Further, it will be appreciated that many different types of diesel-powered machines are known in the art. By way of non-limiting example, diesel-powered machines may include passenger or commercial vehicles, motorcycles, all-terrain vehicles, lawn care equipment, heavy-duty trucks, trains, airplanes, ships, construction vehicles and equipment, generators, military vehicles, or any other machine that utilizes a diesel engine. As such, it will be appreciated that the DEF storage system 12 of the present invention could be used in connection with any suitable diesel-powered machine 16.

The DEF storage system 12 includes a storage tank 18 adapted to store DEF. The storage tank 18 is configured to be operatively mounted to the diesel-powered machine 16. The DEF storage system 12 also includes a receiver 20 spaced from and in selective fluid communication with the storage tank 18. The receiver 20 is configured to be mounted to the diesel-powered machine 16 in an easily accessible location. However, those having ordinary skill in the art will appreciate that the receiver 20 could be mounted in any suitable location with respect to the diesel-powered machine 16 without departing from the scope of the present invention. The receiver 20 is adapted to receive DEF from the DEF supply system 14 and may be designed so as to ensure a "dry-break" when disconnected from the DEF supply system 14. Interaction between receiver 20 and the DEF supply system 14 is discussed in greater detail below.

In one embodiment, the DEF storage system 12 further includes a supply line 22 extending between a first end 24 and a second end 26. The first end 24 of the supply line 22 is connected to the receiver 20 and the second end 26 of the supply line 22, which is in selective fluid communication with the storage tank 18, as is discussed more thoroughly below. The supply line 22 is configured to be routed between the receiver 20 and the storage tank 18 in any suitable way depending on the application. Specifically, those having ordinary skill in the art will appreciate that the storage tank 18 could be mounted to a diesel-powered machine 16 in such a way that it is spaced far from the receiver 20, thus necessitating a long supply line 22 with several twists and bends. However, those having ordinary skill in the art will appreciate that the receiver 20 could be spaced with respect to the storage tank 18 in any suitable way without departing from the scope of the present invention. Further, those having ordinary skill in the art will appreciate that the supply line 22 could be constructed of any suitable material and could be connected to the receiver 20 in any suitable way without departing from the scope of the present invention The DEF storage system 12 also includes a shut-off valve 28. As shown in FIG. 1, the shut-off valve 28 is operatively attached to the storage tank 18. However, those having ordinary skill in the art will appreciate that the shut-off valve 28 could be mounted in any suitable location without departing from the scope of the present invention. The shut-off valve 28 is connected the second end 26 of the supply line 22 and controls selective fluid communication between the storage tank 18 and the receiver 20, as is discussed more thoroughly below. The shut-off valve 28 has a first position, indicated by the arrow at 30, and a second position, indicated at 32. When the shut-off valve 28 is in the first position 30, the supply line 22 is in fluid communication with the storage tank 18. Thus, it will be appreciated that the storage tank 18 can be filled with DEF when the shut-off valve 28 is in the first position. Further, when the shut-off valve 28 is in the second position 32, the storage tank 18 is sealed from the supply line 22. Thus, it will be appreciated that the storage tank 18 can not be filled with DEF when the shut-off valve 28 is in the second position. The shut-off valve is movable from the first position 30 to the second position 32 in response to a predetermined amount of DEF accumulating in the storage tank 18.

Those having ordinary skill in the art will appreciate that the shut-off valve 28 could be designed to move from the first position 30 to the second position 32 in a number of different ways. By way of non-limiting example, the shut-off valve 28 could include a solenoid that receives signals from one or more control systems of the diesel-powered machine 16 (not shown, but generally known in the related art), such that the control system actuates the solenoid of the shut-off valve 28 in response to feedback received from a pressure transducer or fluid level sensor monitoring the storage tank 18 (not shown, but generally known in the art). Further, those having ordinary skill in the art will appreciate that the shut-off valve 28 could be of any suitable form or configuration and be controlled in any suitable way using signals received from any suitable source without departing from the scope of the present invention.

In one embodiment, the shut-off valve 28 of the DEF storage system 12 cooperates with a vent unit 34 such that air can escape the storage tank 18 when the storage tank 18 is being filled with DEF. In this way, the air in the tank is not pressurized during filling. To this end, the vent unit 34 may be include a one-way valve 38 (sometimes called a "check valve") that allows pressurized air to escape as exhaust 38, but that also does not allow ambient air to re-enter. Further, the vent unit 34 may be designed to cooperate with the shut-off valve 28 so as to prevent a vacuum forming in the storage tank 18 as the DEF is consumed in operation of the diesel-powered machine 16. To prevent contamination of the DEF in the storage tank 18, the vent unit 34 may include an air filter 40 to prevent particulates and other contaminates from entering the DEF storage system 12. As shown in FIG. 1, the vent unit 34 is formed as a separate component from the shut-off valve 28. However, those having ordinary skill in the art will appreciate that the vent unit 34 could be integrated with the shut-off valve 28 without departing from the scope of the present invention. Similarly, the one-way valve 36 and/or the air filter 40 could be integrated directly into the vent unit 34 or the shut-off valve 28 without departing from the scope of the present invention.

As mentioned above, the DEF system 10 also includes a DEF supply system 14. The DEF supply system 14 is used to fill the DEF storage system 12. Those having ordinary skill in the art will appreciate that the DEF supply system 14 could be stationary (for example, where the DEF storage system 12 is integrated with a mobile diesel-powered machine 16, such as a truck) or could be mounted to a service vehicle (for example, where the DEF storage system 12 is integrated with a stationary diesel-powered machine 16, such as a generator), depending on the application.

The DEF supply system 14 includes a main supply tank 44 adapted to store DEF. The DEF supply system 14 also includes a nozzle 46 spaced from and in fluid communication with the main supply tank 44. The nozzle 46 is used to releasably attach to the receiver 20 of the DEF storage system 12. Those having ordinary skill in the art will appreciate that the nozzle 46 and receiver 20 could be designed in several different ways and could releasably attach in any suitable way without departing from the scope of the present invention.

In one embodiment, the DEF supply system 14 also includes a feed line 48 extending between a proximal end 50 and a distal end 52. The distal end 52 is connected to the nozzle 46. The DEF supply system 14 may also include a hose reel 53 integrated with the feed line 48 so as to allow the feed line 48 to be retracted and extended in operation. The DEF supply system 14 also includes a fluid pump 54 that has a fluid input 56 and a fluid output 58. The fluid input 56 is connected to the main supply tank 44, and the fluid output 58 is connected the proximal end 50 of the feed line 48 such that the main supply tank 44 is in fluid communication with the nozzle 46. As illustrated in FIG. 1, the fluid pump 54 is positioned outside of the main supply tank 44. However, those having ordinary skill in the art will appreciate that the fluid pump 54 could be mounted within the main supply tank 44 or attached directly thereto without departing from the scope of the present invention. Further, those having ordinary skill in the art will appreciate that the fluid pump 54 could be of any type or configuration suitable to displace DEF from the main supply tank 44 of the DEF supply system 14 to the storage tank 18 of the DEF storage system 12, without departing from the scope of the present invention. As illustrated in FIG. 1, the DEF supply system 14 could also include an air compressor 60 used to power the fluid pump 54. However, those having ordinary skill in the art will appreciate that the fluid pump 54 could be powered in other ways, such as by an electric or hydraulic motor, without departing from the scope of the present invention.

In one embodiment, the fluid pump 54 has a first pumping direction, indicated by the arrow at 62, and a second pumping direction, indicated by the arrow at 64. In the first pumping direction 62, the fluid pump 54 displaces DEF from the main supply tank 44 of the DEF supply system 14 to the storage tank 18 of the DEF storage system 12. In the second pumping direction 64, the fluid pump 54 reverses flow and drains DEF from the supply line 22 of the DEF storage system 12 back to the main supply tank 44 of the DEF supply system 14. The fluid pump 54 is switchable from the first pumping direction 62 to the second pumping direction 64 in response to a predetermined increase in pressure encountered in the feed line 48 and/or at the nozzle 46 of the DEF supply system 14. Specifically, the pressure increase may occur when the shut-off valve 28 of the DEF storage system 12 moves to the second position 32, indicating that the storage tank 18 of the DEF storage system 12 is full. Those having ordinary skill in the art will appreciate that pressure increase can be detected by the DEF supply system 14 in a number of different ways. By way of non-limiting example, a pressure transducer could monitor the pressure in the feed line 48 and/or at the nozzle 46, or the fluid pump 54 could be monitored for changes in operating current, voltage, flow, or pressure, etc. Further, it is conceivable that the DEF supply system 14 could be disposed in communication with the DEF storage system 12 such that the DEF storage system 12 otherwise commands, drives, or tells the DEF supply system 14 to switch to the second pumping direction 64.

In another embodiment, the DEF supply system 14 has additional components and drains the supply line 22 of the DEF storage system 12 in a different way, as is discussed in greater detail below. Specifically, in the second embodiment, the nozzle 46 has a feed port 68 connected to the distal end 52 of the feed line 48. Further, the nozzle 46 also has a return port 68. The fluid pump 54 has a first pumping state, indicated by the arrow at 70, and a second pumping state, indicated at 72. In the first pumping state 70, the fluid pump 54 displaces DEF from the main supply tank 44 of the DEF supply system 14 to the storage tank 18 of the DEF storage system 12. In the second pumping state 72, the fluid pump 54 stops flow. The fluid pump 54 is switchable from the first pumping state 70 to the second pumping state 72 in response to a predetermined increase in pressure encountered in the feed line 48 of the DEF supply system 14, as is discussed more thoroughly above with respect to the first embodiment. Further, the DEF supply system 14 also includes a return line 74 extending between an initial end 76 and a final end 78, with the final end 78 being connected to the return port 68 of the nozzle 46. The initial end 76 may be connected directly to the main supply tank 44, or may be connected to the fluid input 56 of the fluid pump 54 (see FIG. 1). Further, the DEF supply system 14 of the second embodiment also includes a venturi pump 80. As illustrated, the venturi pump is integrated into the nozzle 46 and is powered by an air supply line 82 connected to the air compressor 60. However, those having ordinary skill in the art will appreciate that the venturi pump 80 could be used in any suitable location without departing from the scope of the present invention. Further still, the DEF supply system 14 may also include an air treatment unit 84 configured to optimize the pressurized air used to power the venturi pump 80 and ensure that no contaminants are introduced into the DEF system 10. The venturi pump 80 is in fluid communication with the return line 74 such that the venturi pump 80 is adapted to drain DEF from the supply line 22 of the DEF storage system 12 back to the main supply tank 44 of the DEF supply system 14 via the return line 74 in response to the fluid pump 54 switching from the first pumping state 70 to the second pumping state 72. Specifically, those having ordinary skill in the art will appreciate that the venturi pump 80 described above creates a vacuum source that causes DEF to drain from the supply line 22 of the DEF storage system 12. Further, those having ordinary skill in the art will appreciate that any suitable pump (for example, a jet-energized pump or any other vacuum-generating device), positioned in any suitable location, using any type of power source sufficient to create a vacuum source as described above, could be used in place of the venturi pump 80 without departing from the scope of the present invention. Those having ordinary skill in the art will appreciate that DEF drained from the supply line 22 of the DEF storage system 12 could potentially become aerated due to the venturi pump 80. As such, the DEF supply system 14 may also include a separator 86 and a filtered vent 88 to separate out the DEF from the air.

In one embodiment, the present invention also relates to a method of filling a DEF storage tank 18 on a diesel-powered machine 16 using the storage system 12 and supply systems 14 described above. The method includes the steps of: providing a diesel-powered machine 16 that has a DEF storage system 12 including a receiver 20 connected by a supply line 22 to a shut-off valve 28 mounted on a storage tank 18; providing a DEF supply system 14 that has main supply tank 44 connected to a fluid input 56 of a fluid pump 54 and a nozzle 46 connected by a feed line 48 to a fluid output 58 of the fluid pump 54; connecting the receiver 20 to the nozzle 46; operating the fluid pump 54 such that the main supply tank 44 is in fluid communication with the storage tank 18 and DEF is pumped thereto; sensing a predetermined pressure increase in the feed line 48 indicating that the shut-off valve 28 of the storage system 12 has closed; draining the supply line 22 of the storage system 12; and disconnecting the nozzle 46 from the receiver 20.

In this way, the various component and systems of the present invention cooperate to enable the storage tank 18 of the DEF storage system 12 to be filled with DEF in a quick, simple, and reliable way. Further, those having ordinary skill in the art will appreciate that the present invention allows the supply line 22 of the DEF storage system 12 to be drained of DEF immediately following filling of the storage tank 18, such that the supply line 22 is substantially emptied of DEF. Thus, the supply line 22 need not be heated or otherwise prevented from freezing to prevent expansion of DEF, which could cause cracking and lead to leaking and contamination. Thus, the DEF storage system 12 of the present invention can be used in harsher environments with colder temperatures than otherwise previously available in the art. Further, it will be appreciated that draining the supply line 22 leads to a decrease in manufacturing, maintenance, and assembly costs, as expensive heating and routing systems need not be utilized. Further, the systems of the present invention greatly reduce the risk of contaminating DEF in both DEF supply systems 14 and DEF storage systems 12 as discussed above.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A diesel exhaust fluid storage system for use on a diesel-powered machine, said storage system comprising:

a storage tank adapted to store a diesel exhaust fluid;

a receiver disposed in selective fluid communication with said storage tank and adapted to receive the diesel exhaust fluid; and a shut-off valve interposed in fluid communication between said storage tank and said receiver, said shut-off valve having:

a first position wherein the diesel exhaust fluid can flow across said shut-off valve from said receiver to said storage tank, and a second position wherein flow is interrupted across said shut-off valve from said receiver to said storage tank; wherein said shut-off valve moves from said first position to said second position in response to a predetermined accumulation of the diesel exhaust fluid in said storage tank; and a fluid pump that acts to fill said storage tank, said fluid pump including a first pumping direction wherein the diesel exhaust fluid is displaced across said fluid pump from a main supply tank to said storage tank; and a second pumping direction wherein said fluid pump reverses flow direction such that the diesel exhaust fluid is drained across said fluid pump; wherein said fluid pump switches from said first pumping direction to said second pumping direction in response to a predetermined increase in fluid pressure in a diesel exhaust fluid supply system.

2. The diesel exhaust fluid storage system as set forth in claim 1, wherein said shut-off valve is operatively attached to said storage tank.

3. The diesel exhaust fluid storage system as set forth in claim 1, further including a supply line extending between said storage tank and said receiver.

4. The diesel exhaust fluid storage system as set forth in claim 3, wherein said supply has: a first end connected to said receiver; and a second end connected to said shut-off valve.

5. The diesel exhaust fluid storage system as set forth in claim 3, wherein said shut-off valve seals said storage tank from said supply line when said shut-off valve is in said second position.

6. The diesel exhaust fluid storage system as set forth in claim 1, wherein said receiver is spaced from said storage tank and/or said shut-off valve.

7. The diesel exhaust fluid storage system as set forth in claim 1, wherein said storage tank and said receiver are configured to be operatively mounted to the diesel-powered machine.

8. A diesel exhaust fluid supply system for cooperating with a diesel-powered machine having a diesel exhaust fluid storage system including a receiver disposed in fluid communication with a shut-off valve mounted on a storage tank via a supply line, said supply system comprising:

a main supply tank adapted to store diesel exhaust fluid;

a nozzle disposed in selective fluid communication with said main supply tank for releasably attaching to the receiver of the storage system; and a fluid pump interposed in fluid communication between said main supply tank and said nozzle for filling the storage tank when said nozzle is releasably attached to the receiver, said fluid pump having: a first pumping direction wherein diesel exhaust fluid is displaced across said fluid pump from said main supply tank to the storage tank; and a second pumping direction wherein said fluid pump reverses flow direction such that diesel exhaust fluid is drained across said fluid pump from the supply line to said main supply tank; wherein said fluid pump switches from said first pumping direction to said second pumping direction in response to a predetermined increase in fluid pressure occurring at said nozzle.

9. The diesel exhaust fluid supply system as set forth in claim 8, further including a feed line extending between said nozzle and said fluid pump.

10. The diesel exhaust fluid supply system as set forth in claim 9, wherein said fluid pump has: a fluid input connected to said main supply tank; and a fluid output connected to said feed line.

11. The diesel exhaust fluid supply system as set forth in claim 10, wherein said feed line has: a proximal end connected to said fluid output of said fluid pump; and a distal end connected to said nozzle.

12. The diesel exhaust fluid supply system as set forth in claim 10, wherein said first pumping direction of said fluid pump is further defined as a first pumping state, and wherein said fluid pump has a second pumping state wherein said fluid pump stops fluid flow, said fluid pump being switchable from said first pumping state to said second pumping state in response to a predetermined increase in fluid pressure occurring at said nozzle; and wherein said nozzle includes: a feed port in fluid communication with said fluid output of said fluid pump; and a return port in fluid communication with said main supply tank or said fluid input of said fluid pump.

13. The diesel exhaust fluid supply system as set forth in claim 12, further including a return line extending between an initial end and a final end with said final end connected to said return port of said nozzle and said initial end being connected to one of said main supply tank and said fluid input of said fluid pump.

14. The diesel exhaust fluid supply system as set forth in claim 13, further including a venturi pump disposed in fluid communication with said return line and adapted to drain diesel exhaust fluid from the supply line of the storage system to said main supply tank via said return line in response to said fluid pump switching to said second state.

15. A diesel exhaust fluid system comprising:

a storage system for use on a diesel-powered machine, said storage system including:

a storage tank adapted to store diesel exhaust fluid, a receiver disposed in selective fluid communication with said storage tank and adapted to receive diesel exhaust fluid, a supply line extending between said storage tank and said receiver, and a shut-off valve interposed in fluid communication between said storage tank and said receiver, said shut-off valve having: a first position wherein diesel exhaust fluid can flow across said shut-off valve from said receiver to said storage tank and a second position wherein flow is interrupted across said shut-off valve from said receiver to said storage tank and wherein said shut-off valve moves from said first position to said second position in response to predetermined accumulation of diesel exhaust fluid in said storage tank; and a supply system for filling said storage system, said supply system including:

a main supply tank adapted to store diesel exhaust fluid, a nozzle disposed in selective fluid communication with said main supply tank for releasably attaching to said receiver of said storage system, and a fluid pump interposed in fluid communication between said main supply tank and said nozzle for filling said storage tank when said nozzle is releasably attached to said receiver, said fluid pump having: a first pumping direction wherein diesel exhaust fluid is displaced across said fluid pump from said main supply tank to said storage tank; and a second pumping direction wherein said fluid pump reverses flow direction such that diesel exhaust fluid is drained across said fluid pump from said supply line to said main supply tank; wherein said fluid pump switches from said first pumping direction to said second pumping direction in response to a predetermined increase in fluid pressure occurring at said nozzle.

16. The diesel exhaust fluid system as set forth in claim 15, wherein said shut-off valve seals said storage tank from said supply line when said shut-off valve is in said second position.

17. The diesel exhaust fluid system as set forth in claim 15, wherein said receiver is spaced from said storage tank and/or said shut-off valve.

18. The diesel exhaust fluid system as set forth in claim 15, wherein said first pumping direction of said fluid pump is further defined as a first pumping state, and wherein said fluid pump has a second pumping state wherein said fluid pump stops fluid flow, said fluid pump being switchable from said first pumping state to said second pumping state in response to a predetermined increase in fluid pressure occurring at said nozzle; and wherein said nozzle includes: a feed port in fluid communication with said fluid pump; and a return port in fluid communication with said main supply tank.

19. The diesel exhaust fluid system as set forth in claim 15, further including a return line extending between an initial end and a final end with said final end connected to said return port of said nozzle, and said initial end connected to said main supply tank.

20. The diesel exhaust fluid system as set forth in claim 19, further including a venturi pump disposed in fluid communication with said return line and adapted to drain diesel exhaust fluid from said supply line to said main supply tank via said return line in response to said fluid pump switching to said second state.

* * * * *